United States Patent [19]

Ricci

[11] 4,364,481

[45] Dec. 21, 1982

[54] SHELF ORGANIZER

[75] Inventor: Albert A. Ricci, Yonkers, N.Y.

[73] Assignee: Bristol-Myers Company, New York, N.Y.

[21] Appl. No.: 198,571

[22] Filed: Oct. 20, 1980

[51] Int. Cl.[3] ..... B01B 23/00

[52] U.S. Cl. ..... 211/184; 206/558; 211/153

[58] Field of Search ..... 211/184, 183, 11, 49 R, 211/153; 206/558, 561; 220/22.3

[56] References Cited

U.S. PATENT DOCUMENTS

| | | | |
|---|---|---|---|
| 1,190,964 | 7/1916 | Snyder et al. | 206/558 |
| 1,655,183 | 1/1928 | Gibson | 206/561 |
| 1,666,851 | 4/1928 | Good | 206/558 |
| 1,750,576 | 3/1930 | Cubberley | 220/22.3 |
| 2,056,683 | 10/1936 | Mattman | 211/184 X |
| 2,108,122 | 2/1938 | Hall | 211/49 R |
| 2,294,155 | 8/1942 | Boddy | 211/153 |
| 3,300,057 | 1/1967 | Wheaton | 211/184 |
| 3,409,140 | 11/1968 | Woolf | 211/13 |
| 3,651,976 | 3/1972 | Chadbourne | 206/558 X |
| 4,006,824 | 2/1977 | Snediker et al. | 211/49 D |

FOREIGN PATENT DOCUMENTS

| | | | |
|---|---|---|---|
| 688284 | 6/1964 | Canada | 211/49 |
| 2915910 | 10/1980 | Fed. Rep. of Germany | 211/184 |

*Primary Examiner*—Roy D. Frazier
*Assistant Examiner*—Peter A. Aschenbrenner
*Attorney, Agent, or Firm*—Irving Holtzman; George A. Mentis

[57] ABSTRACT

A variable shelf organizer adapted to being assembled to provide shelf organizers of various sizes. The elements are constructed so that portions of them may be broken away to adjust both the length and the width and so that the parts interlock to give product troughs of various widths.

6 Claims, 7 Drawing Figures

1
5
11
13
17
19
21
23
25
27
28
3
3

SHELF ORGANIZER

This invention relates to a shelf organizer and more particularly, to a shelf organizer which is capable of being adjusted to various sizes.

In the present day marketing of consumer products of the type ordinarily found in large self-service stores such as the supermarkets, it is important to be able to maintain the display of products in a suitable and orderly fashion. This is difficult in supermarkets where, in addition to the stock clerks, the items are constantly being removed and replaced by the customer. This calls for a means of organizing the products disposed on the store shelf so that they do not readily become mixed with other goods thus creating a lot of confusion.

Shelf organizers are obviously well known in the prior art. However, they generally have limitations in their ability to accommodate varying sizes of products that are to be stored on the shelves as well as the shelf sizes. This invention provides a means for overcoming these drawbacks.

It is accordingly an object of the present invention to provide a shelf organizer designed to accommodate varying sizes of products and shelf sizes.

Other and more detailed objects of this invention will be apparent from the following description and drawings in which.

Figure 1:
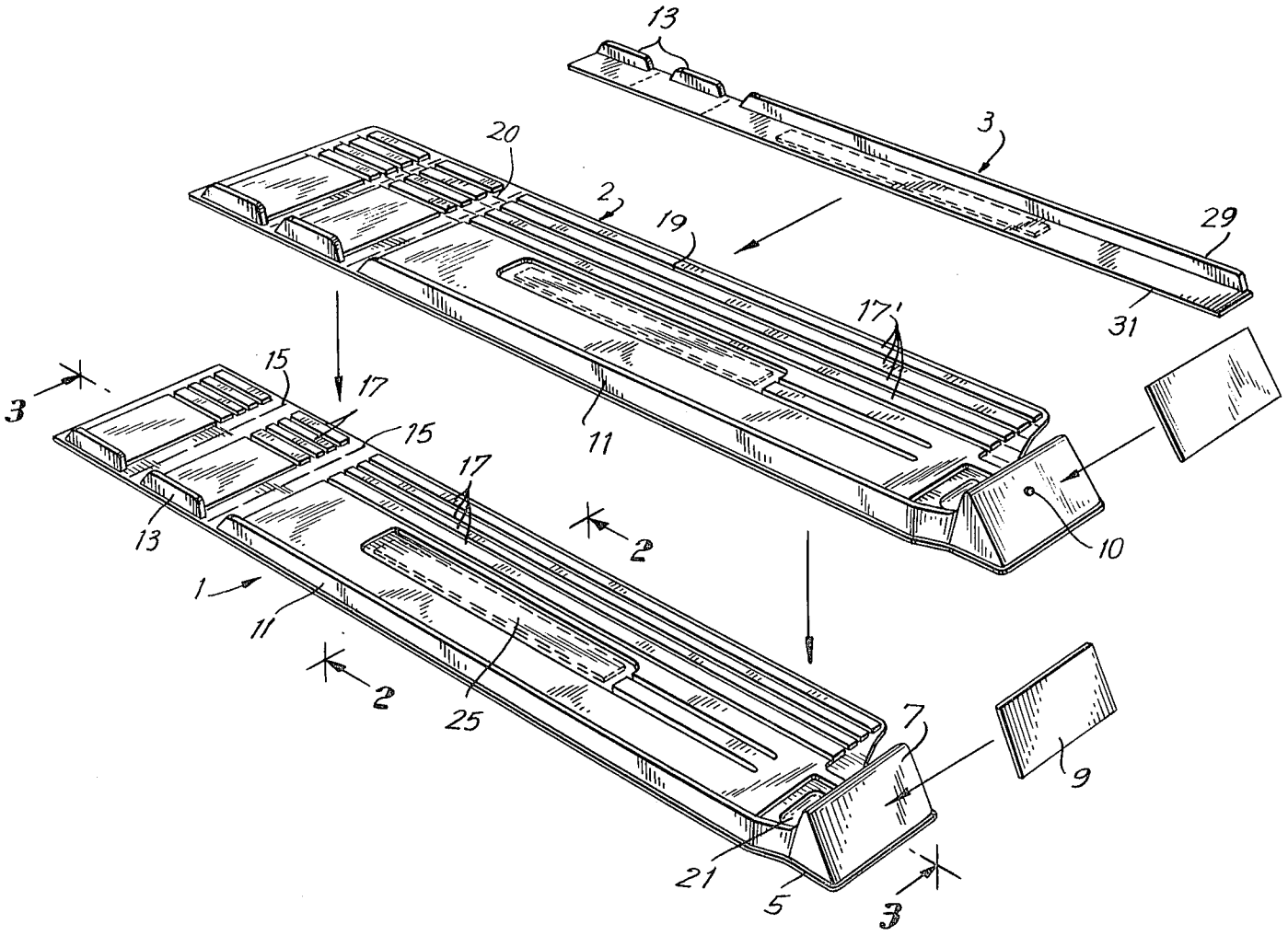
FIG. 1 is an assembly drawing showing the manner in which the various components of the present shelf organizer may be assembled.

Referring to the figures in the drawings in which the numerals in the various views designate the same structure, the regular shelf organizer unit is shown generally at 1. The longitudinally perforated shelf organizer described in more detail below is shown at 2 whereas the end strip, the last component, is shown at 3. In the embodiment illustrated only one regular organizer unit 1 is depicted. It is clear, however, that two or more regular organizer units or, if desired, even two or more longitudinally perforated organizer units 2 can be utilized.

Each regular organizer unit 1 is provided with non-detachable longitudinal elements 17 and a front extension 5 which may be generally triangular in side view and may be further provided with a front panel 7. Front panel 7 can serve as a surface to which information labels (e.g. price or product information) 9 may be affixed.

Each regular shelf organizer unit 1 has a laterally disposed barrier element 11 forming the left side of each trough that is formed when the organizer units are assembled. In the embodiment illustrated, this is shown as being formed by molding the material to provide an upwardly extending rounded spike best shown in FIG. 2.

Since the depth of the shelves on which the shelf organizer is to be employed may vary, provision is made to adjust the length of the shelf organizer. This is accomplished by providing detachable end elements 13. Although only two such elements are shown in the embodiment, it is to be understood that several additional end elements may be provided.

Figures 2, 3, 4:
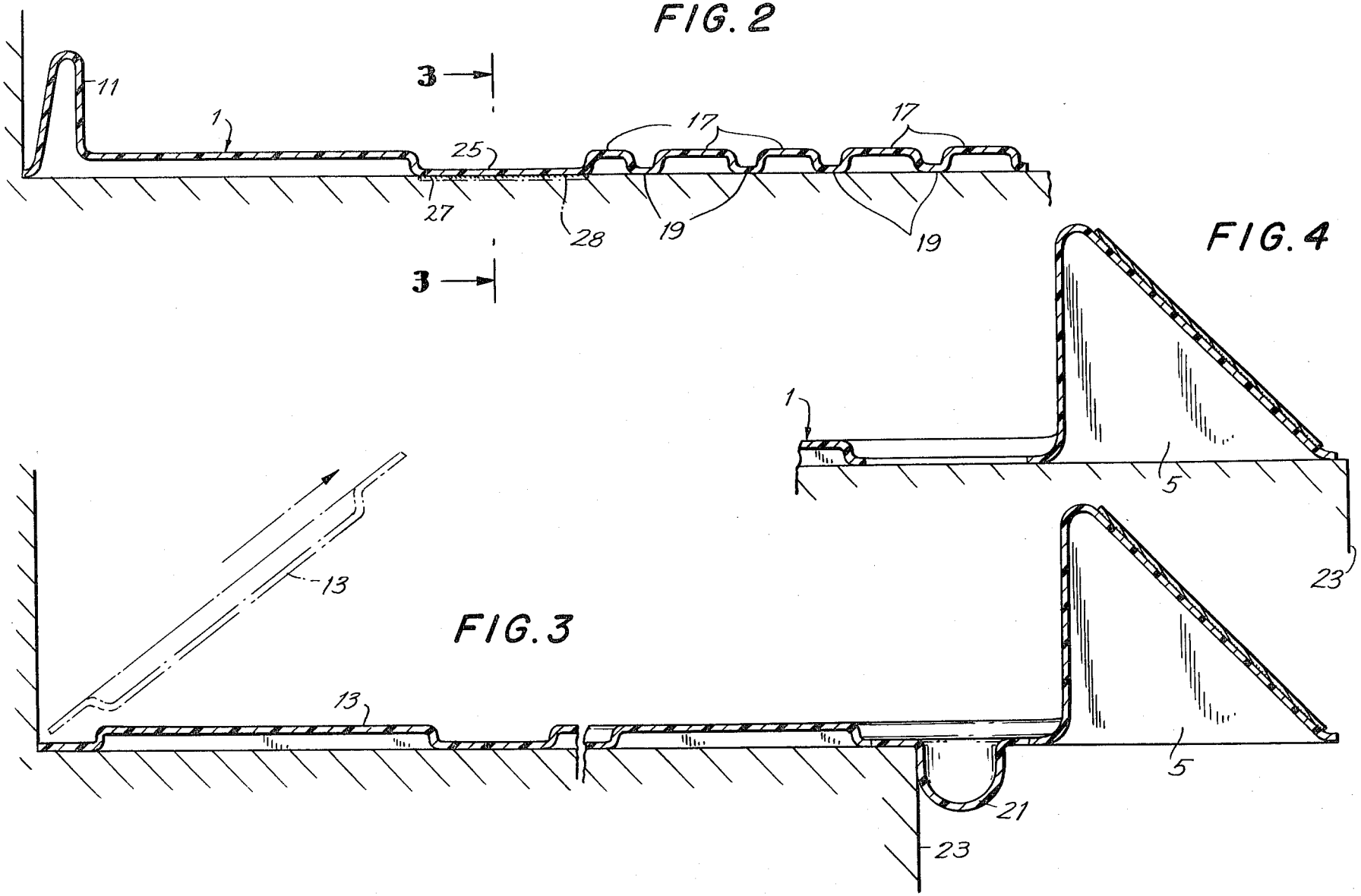
FIG. 2 is a horizontal cross-sectional view taken through line 2—2 of the lower member shown in FIG. 1.
FIG. 3 is a longitudinal cross-sectional view of the lower element shown in FIG. 1 taken along line 3—3, the view being broken as indicated showing the rear detachable element being removed, the stop in the front extension in place and the shelf organizer extending beyond the shelf.
FIG. 4 is a partial view similar to that shown in FIG. 2 showing the stop in the front extension removed and the shelf organizer flush with the end of the shelf.

To assist in detaching these end elements 13, perforations 15 are provided which assist in breaking each element off. FIG. 3 illustrates the manner by which this is accomplished. As will be seen, the last end element 13 has been bent upwardly and backwardly thereby fracturing its attachment along perforation 15 and thereby facilitating its removal.

Figure 7:
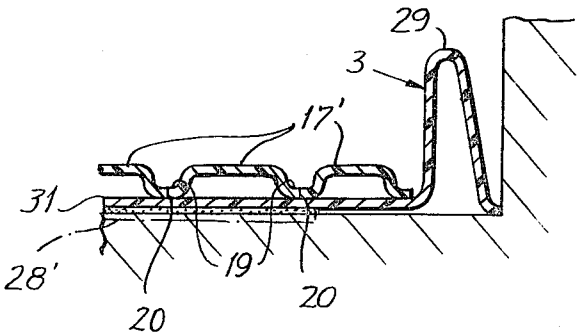
FIG. 7 is a partial cross-sectional view of FIG. 6 taken along lines 7—7.

Longitudinal perforated shelf organizer unit 2 is provided so that the overall width of the assembled units can be varied somewhat. To accomplish this, there is provided in each longitudinal shelf organizer unit 3 a plurality of longitudinal detachable elements 17'. As seen in FIG. 7, these may be formed as upwardly extending generally inverted rectangular channels that run in a longitudinal direction. Between each of these elements, there is provided grooves 19. The floor of groove 19 is constructed so as to have perforations 20 or weakened lines that run the full length of grooves 19. This enables the detachment of each detachable element 17' as required in the adjustment of the overall width of the assembled organizer units.

In essentially all other respects, longitudinal perforated organizer unit 2 is constructed like the regular shelf organizer unit 1. However, to readily distinguish between the two, the perforated organizer unit 2 is provided with an identifying dent 10.

It is often desirable to have the option of being able to have the front extension extend beyond the end of the shelf or to have it flush with the shelf ending. With this in mind, there is provided a removable stop 21 best shown in FIG. 3. In FIG. 3, the stop is shown in position and the front extension 5 is shown extending beyond the end of shelf 23. In FIG. 4, the stop 21 has been removed and front extension 5 is shown as being flush with shelf 23.

To prevent the movement of the shelf organizer units on the shelves, the undersurface of depressed panel 25 is provided with a coating of a pressure sensitive adhesive 27. This may be protected by a strip of paper 28 until just before mounting the organizer units on the shelf. At that time, the protective paper is removed and the pressure sensitive adhesive is exposed for sealing the units to the shelf.

End strip 3 is shaped to form a barrier element for the right side of the assembled shelf organizer. This is constructed so as to have an upwardly extending guard element 29 and a horizontally extending floor element 31. Detachable end elements 13 are also provided in end strip 3. A portion of the undersurface of floor 31 is also provided with a coating of pressure sensitive adhesive 27. As in the case with the regular organizer units 1, this adhesive strip may also be protected by a strip of paper 28' which is to be removed just before the end strip 3 is placed in the assembly.

Figure 5:
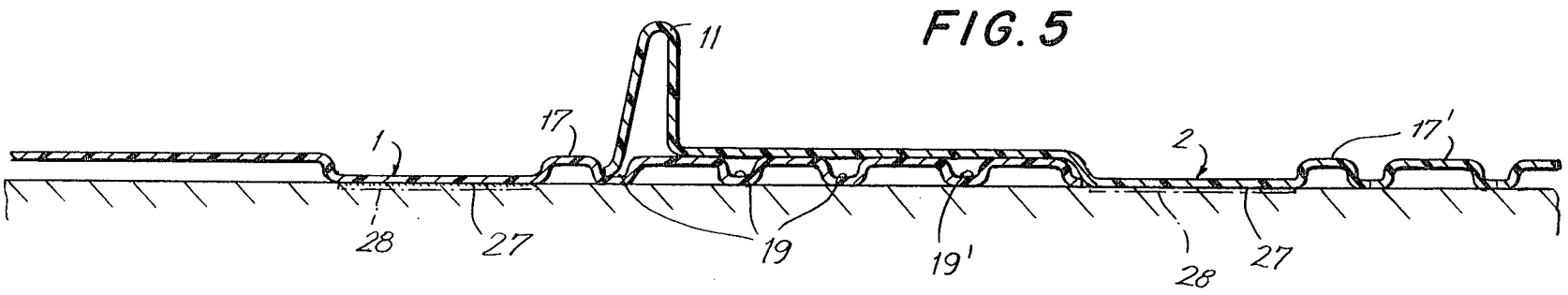
FIG. 5 is a partial cross-sectional view of the lower and middle element of FIG. 1 shown in assembled condition.

The interlocking relationship of regular organizer unit 1 and longitudinal perforated organizer unit 2 when these elements are assembled is best seen in FIG. 5. This also illustrates how it is possible to adjust the width of the individual longitudinal trough formed when these elements are assembled. As will be seen in FIG. 5, these elements are locked together along their longitudinal dimension by inserting the outside leg of spike 11 of one shelf organizer unit into a groove 19 of the adjacent organizer. If it is desired to provide a trough of greater width, the outer leg of spike 11 can be inserted in groove 19'.

Figure 6:
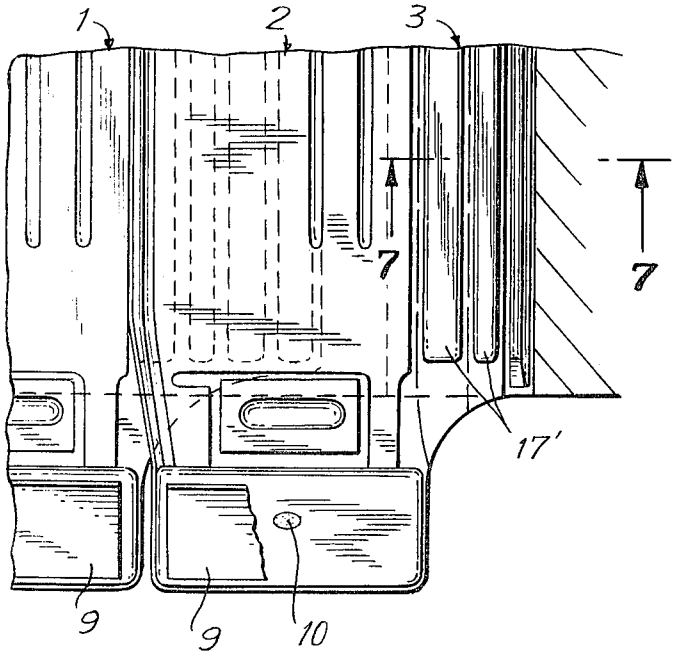
FIG. 6 is a partial top plan view of the elements of FIG. 1 shown in the assembled condition.

FIG. 6 shows the relationship of all of the elements 1, 2 and 3 in the assembled condition as seen from above. The information label 9 is shown partly torn away to show the underlying identifying dent 10 which identifies this element as a longitudinal perforated organizer unit 2. End strip 3 is assembled by slipping its floor 31 under the lower surface of perforated organizer unit 2 until the right hand margin of organizer unit 2 abuts the guard 29 of end strip 3. This relationship is best seen in FIG. 7.

The parts of the present shelf organizer can be fabricated of any of a variety of materials. Ordinarily, it will be made of a thin, flexible plastic material such as utility grade styrene, high impact styrene (containing 30% rubber), etc.

The shelf organizer may be assembled by using the following procedure:

(1) Decide whether or not you want the organizer to extend beyond the shelf channel, or to be flush with the edge of the shelf. If you want the display area to extend beyond the shelf, line up the organizer so that the stop 21 presses up against the front surface of the shelf. This method insures that the organizer is resting properly (in a straight line) on the shelf. If you want the display area to be flush with the edge of the shelf, simply remove stop 21 by pushing it in. The perforated margins of stop 21 facilitate its removal.

(2) Place you regular organizer unit 1 on the shelf (do not remove the protective paper from the adhesive yet). Determine how deep the shelf is, and tear along the horizontal perforations 15 to adjust the organizer for shelf depth. Remove the protective paper strips. Place the organizer on the shelf and press firmly along the area above the adhesive to ensure that it sticks.

(3) Next, place one piece of product in the organizer to see how wide a space you need for that piece. Take your next organizer piece; adjust it for the correct shelf depth, and, if you have chosen to do so, remove the stop 21. Place the second organizer over the groove of the first organizer that gives you the best fit for the width of the package. Remove the protective paper strip 28, place the organizer on the shelf in the groove you chose and press above the adhesive strip to ensure a tight bond.

(4) Continue the same procedure until you get to the last regular organizer unit.

(5) For the last organizer unit, use the perforated organizer 2 i.e. the one with the "indented dot 10" on the label area. Adjust the organizer for shelf depth; and if you have chosen to do so, remove the stop 21. Next, place one piece of product in the perforated organizer 2 to see how wide a space you need, and tear along the longitudinal perforations to adjust the organizer to the correct width. However, do not stick the perforated organizer to the shelf yet.

(6) Take one end strip 3. The guard 29 should be on the right hand side, the flat floor 31 on the left. Place the flat floor 31 of the end strip 3 under the perforated organizer 2 until the left hand margin of perforated organizer 2 is up against the guard 29 of end strip 3. Remove the protective paper strips 28 and 28' on both pieces, and put both in place simultaneously.

(7) Place the appropriate product labels 9 over the panels 7 on each organizer unit.

Although the invention has been described with reference to specific forms thereof, it will be understood that many changes and modifications may be made without departing from the spirit of this invention.

What is claimed is:

1. A variable shelf organizer adapted to being assembled to give shelf organizers of different overall horizontal dimensions as well as product troughs of various sizes comprising:

(a) at least one regular organizer unit, at least one longitudinally perforated organizer unit and at least one end strip;

(b) said regular organizer unit comprising a longitudinally extending product supporting member provided with a first barrier member extending upward from said supporting member adjacent a lateral margin of said supporting member, said product supporting member also being provided with a plurality of longitudinal grooves adapted to engage a barrier member from an adjacent organizer unit;

(c) said longitudinal perforated organizer unit also comprising a second longitudinally extending product supporting means and second barrier member having inner and outer legs extending upwardly from said product supporting member adjacent a lateral margin of said second product supporting member; said second product supporting member also being provided with a plurality of second longitudinal grooves having weakened lines formed at the bottom thereof whereby portions of said second product supporting member may be broken away to adjust the width of said shelf organizer; and (d) said end strip being provided with a horizontal member adapted to engage an adjacent organizer unit and an upwardly extending member adapted to serve as the guard rail marking lateral termination of the shelf organizer.

2. A shelf organizer according to claim 1 in which each of said regular organizer unit, longitudinally perforated organizer unit and end strip is provided with at least one detachable extension whereby the longitudinal dimension of each of said regular organizer unit, longitudinal perforated organizer unit and end strip is adjustable.

3. A shelf organizer according to claim 2 wherein at least one of said regular organizer unit and said longitudinal perforated organizer unit is provided with a front extension having a removable stop whereby the position of the front end of said shelf organizer may be adjusted to extend beyond the front end of said shelf or to be flush with the front end of said shelf.

4. A shelf organizer according to claim 3 in which said front extension is provided with means for supporting an information label.

5. A shelf organizer according to claim 3 in which at least one of said regular organizer unit, said longitudinal perforated organizer unit and said end strip is provided with an adhesive area over a portion of the undersurface thereof.

6. A shelf organizer according to claim 5 in which each adhesive area is covered over by a protective removable element.

* * * * *